US006148800A

United States Patent [19]

Cari et al.

[11] Patent Number: 6,148,800

[45] Date of Patent: Nov. 21, 2000

[54] INJECTION TEMPERATURE FUEL FEEDBACK

[75] Inventors: Michael J. Cari, Berkley; Timothy A. Coatesworth, Lake Orion; Mark J. Duty, Davison; Chris D. Kapolnek, Dearborn; Gregory L. Ohl, Ann Arbor; Amit K. Sanyal, Troy, all of Mich.; Rajiv Saxena, Livonia, Ill.; Mikhail Zarkhin, Southfield, Mich.

[73] Assignee: DaimlerChrysler Corporation, Auburn Hills, Mich.

[21] Appl. No.: 09/283,452

[22] Filed: Apr. 1, 1999

[51] Int. Cl.[7] ..... F02M 51/00

[52] U.S. Cl. ..... 123/490

[58] Field of Search ..... 123/490, 478, 123/480, 179.15, 179.21, 494, 486, 689

[56] References Cited

U.S. PATENT DOCUMENTS

| | | | |
|---|---|---|---|
| 4,082,066 | 4/1978 | Long | 123/490 |
| 4,143,621 | 3/1979 | Long | 123/491 |
| 4,636,620 | 1/1987 | Wright et al. | 123/490 |
| 4,870,932 | 10/1989 | Asmus | 123/179.21 |
| 4,886,032 | 12/1989 | Asmus | 123/179.15 |
| 5,331,939 | 7/1994 | Trombley et al. | 123/533 |
| 5,435,285 | 7/1995 | Adams et al. | 123/478 |
| 5,474,054 | 12/1995 | Povinger et al. | 123/486 |
| 5,584,277 | 12/1996 | Chen et al. | 123/480 |
| 5,992,391 | 11/1999 | Yamakado et al. | 123/490 |

FOREIGN PATENT DOCUMENTS 8-121227 5/1996 Japan .

OTHER PUBLICATIONS

Dreeban et al; *Effect of Sac Volume on Injector Performance*; Feb. 24, 1992; SAE Technical Paper Series 920680.

*Primary Examiner*—Henry C. Yuen
*Assistant Examiner*—Hieu T. Vo
*Attorney, Agent, or Firm*—Mark P. Calcaterra

[57] ABSTRACT

A method is provided for injecting fuel into an internal combustion engine. The method includes providing the engine with a plurality of fuel injectors, each including an electromechanical mechanism for receiving fuel under pressure via a fuel supply system and for injecting a measured amount of fuel into the engine in response to a command signal whose duration is indicative of the amount of fuel to be injected. The command signal is determined based upon a measured throttle position, engine speed and engine load. A resistance of a solenoid coil of the electromechanical mechanism is then calculated and the command signal is adjusted by incrementing or decrementing the command signal to compensate for variations in the measured resistance of the solenoid coil of electromechanical mechanism due to temperature variations.

2 Claims, 2 Drawing Sheets

INJECTION TEMPERATURE FUEL FEEDBACK

BACKGROUND OF THE INVENTION

Field of the Invention

The present invention relates generally to methods and apparatus for controlling the delivery of fuel to an internal combustion engine, and more particularly to a method for more precisely controlling the amount of fuel delivered in the presence of injector temperature changes.

BACKGROUND AND SUMMARY OF THE INVENTION

Electronic fuel control systems are used in internal combustion engines to precisely meter the amount of fuel required for varying engine requirements. Such systems vary the amount of fuel delivered for combustion in response to multiple system inputs including throttle angle, engine load, and the concentration of oxygen in the exhaust gas produced by combustion of air and fuel. Typical electronic fuel control systems operate in the closed-loop mode in response to sensed exhaust oxygen levels in order to maintain the ratio of air and fuel at or near stoichiometry.

It has been known for some time that the battery voltage (used as the supply for an injector) has a direct effect on the opening speed of a fuel injector. That is, when the battery voltage falls below some nominal value, the injector (a copper wound solenoid) opens more slowly, and consequently, when the voltage is greater than a nominal value, it opens more quickly. This causes a variation in the amount of fuel delivered to the combustion chamber with varying battery voltage for a given pulse width sent by the fuel injector driver circuit. This means that based on battery voltage variations, the pulse width must be incremented or decremented to compensate for the speed at which the injector opens. This phenomenon has been observed, and characterized experimentally. Currently, engine management software has been used to adjust the injector pulse width based on battery voltage.

Temperature also affects the opening time of an injector. Variations in temperature at the injector change the resistance exhibited by the actuating solenoids, and the resistance change in turn alters the time required for the injectors to respond to the actuating signals, resulting in a variation in the amount of fuel delivered by the injectors.

A fuel injector can be modeled as an L/R circuit. The resistance (R) of the injector coil varies as a function of temperature. The following relationship relates resistance as a function of temperature:

$$R_T = R_{T0}[1+\alpha(T-T_0)]$$

Where $\alpha$ is the material temperature coefficient of resistivity, $R_T$ and $R_{T0}$ are the material resistances at temperatures, T and $T_0$, respectively. In view of the relationship between temperature and resistance, it is necessary to find a method to measure this resistance, and then relate the change in resistance to the rate in which the injector opens, hence, the amount of fuel delivered. U.S. Pat. No. 5,474,054 discloses an electronic fuel injection control system which alters the duration of the fuel injection command signals by first selecting a predetermined correction value from a set of such values pre-stored in a look-up table device, wherein the selected value is identified in accordance with both the current fuel pressure and current injector temperature. The injector temperature is determined using a temperature sensor in the fuel supply conduit near the injectors. However, this technique is undesirable since it requires the addition of a temperature sensor for each fuel injector and does not measure the temperature of the injector, rather it measures the temperature in the conduit feeding the injector with fuel.

Accordingly, it is an object of the present invention to provide a method to measure the resistance of the injector coils due to variations in the temperature without a temperature sensor.

Accordingly, the present invention provides a method for injecting fuel into an internal combustion engine, comprising the steps of providing the engine with a plurality of fuel injectors, each of the injectors including an electromechanical mechanism for receiving fuel under pressure via a fuel supply system and for injecting a measured amount of fuel into the engine in response to a command signal whose duration is indicative of the amount of fuel to be injected plus the opening and closing times of this mechanism. A command signal is determined for the fuel injectors based upon a measured throttle position, engine speed, engine load, and other engine operating parameters. A resistance of the solenoid coil of the electromechanical mechanism is measured, and the command signal is adjusted by incrementing or decrementing the command signal to compensate for variations in the measured resistance of the solenoid coil of the electromechanical mechanism due to temperature variations. The step of measuring the resistance of the solenoid coil includes providing a circuit including the solenoid coil, and a switch device (e.g., a low side driver) whereby the switch device is opened in order to electrically disconnect the injector driver circuit from the driver and cause a collapse of the electric field in the solenoid coil, generating a fly back pulse. From the measured duration of time that the fly back voltage is clipped at some voltage (by a zener diode or MOSFET switch, etc.), the resistance of the solenoid coil can be determined.

Further areas of applicability of the present invention will become apparent from the detailed description provided hereinafter. It should be understood however that the detailed description and specific examples, while indicating preferred embodiments of the invention, are intended for purposes of illustration only, since various changes and modifications within the spirit and scope of the invention will become apparent to those skilled in the art from this detailed description.

BRIEF DESCRIPTION OF THE DRAWINGS

The present invention will become more fully understood from the detailed description and the accompanying drawings, wherein.

DETAILED DESCRIPTION OF THE PREFERRED EMBODIMENTS

Figure 1:
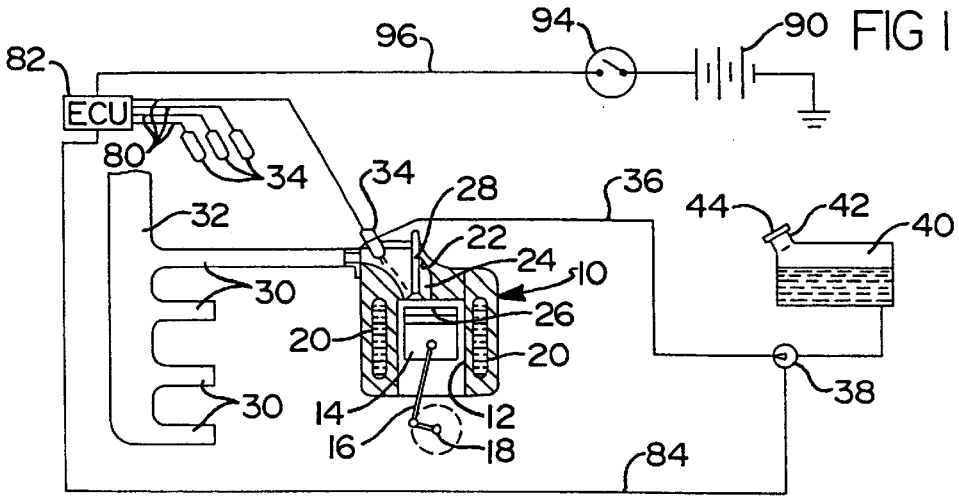
FIG. 1 is a schematic view of the fuel injection system and a partial view of related engine portions according to the principles of the present invention.

Part of a multicylinder internal combustion engine 10 is illustrated in FIG. 1. The engine 10 defines a cylinder 12 in which a piston 14 is reciprocated. The piston 14 is operatively attached to a connecting rod 16 which in turn is attached to a throw of crankshaft 18. To cool the engine, coolant filled passages 20 encircle the cylinder 12. Air is passed into the engine 10 through an intake passage 22 and an inlet portion 24. The air enters the engine's combustion chamber 26 past a poppet-type valve 28 which regulates the introduction of the air. Air supplied to an intake passage 22 of each combustion chamber by air inlet tubes 30 which are connected commonly to an inlet passage 32. Fuel is sprayed into the intake passages 22 by fuel injectors 34 where the fuel mixes with the air. The fuel is supplied to the injectors 34 by supply lines 36. The supply lines 36 receive fuel from an electric fuel pump 38 which is connected to the vehicle fuel tank 40. Tank 40 has inlet or filler tube 42 normally covered by cap 44.

Figure 2:
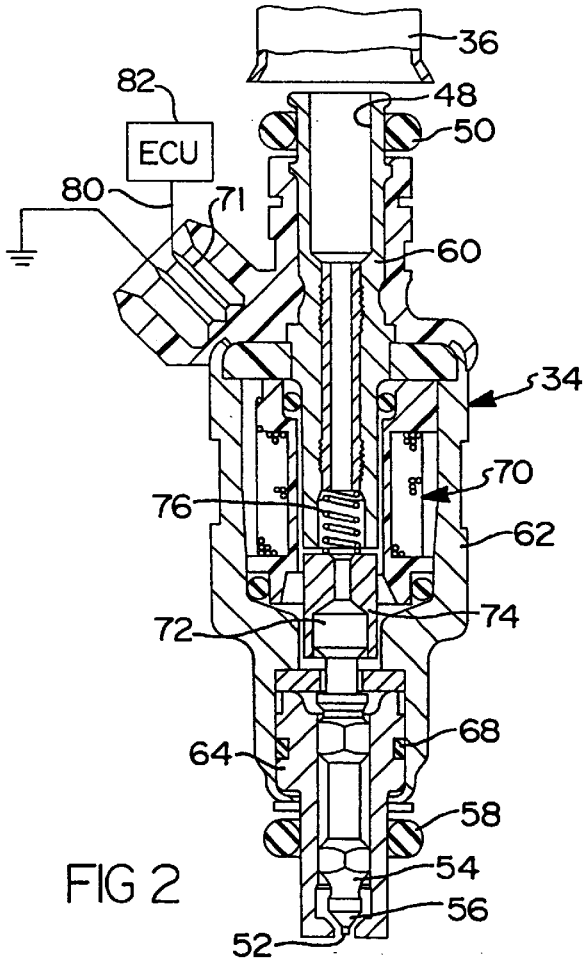
FIG 2 PRIOR ART
FIG. 2 is a sectional elevational view of an exemplary fuel injector shown in FIG. 1.
Figure 3:
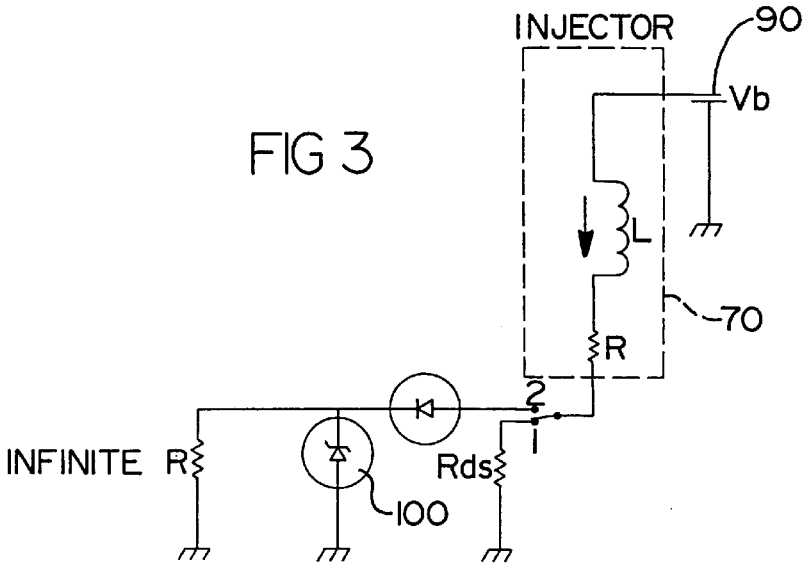
FIG. 3 is a circuit diagram of the fuel injector driver according to the principles of the present invention.

Details of a typical fuel injector are shown in FIG. 2. The fuel injector 34 has an elongated enclosure or housing with an open upper and defining a fuel inlet passage housing with an open upper end defining a fuel inlet passage 48. The upper end is adapted to engage a portion of the fuel supply line 36 in a sealed manner. An O-ring 50 engages a supply line 36 to prevent leakage of fuel. A small orifice or outlet passage 52 is formed in an opposite lower end from the inlet end 48. A valve member 54 is supported for reciprocation in housing and includes a conically-shaped end portion 56. The end portion 56 engages the outlet end portion of the housing to normally block fuel flow through the housing. An O-ring 58 around the outlet end engages the engine structure which forms the intake passage 22 to prevent vacuum leakage therebetween.

Specifically, the structure of injector 34 includes a metal upper portion 60 forming the fuel inlet, a metal mid-portion 62, and a metal outlet forming housing portion 64. Housing portions 60, 62, and 64 are axially aligned one to another and define a fuel flow path from one end to another. The lower portion 64 has a central bore 66 in which valve member 54 reciprocates. The lower end of mid-portion 62 is folded over portion 64 to connect the two and an O-ring seal 68 therebetween seals the two. An elastomeric portion connects the upper and mid-portions.

A tubularly-shaped coil assembly 70 consisting of many wraps of wire is supported within the mid portion 62. An enlarged solenoid plunger portion 74 is attached on the upper end portion 72 of the valve member 64. Portion 74 is partially located within the tubular coil assembly 70. A light spring 76 extends between the lower end of the housing 60 and portion 74. It urges the valve 54 downward against the lower end of the portion 64 to a closed position. In FIG. 2, the valve 54 is illustrated in its upward or open position generated when the solenoid coil 70 is energized.

Figure 4:
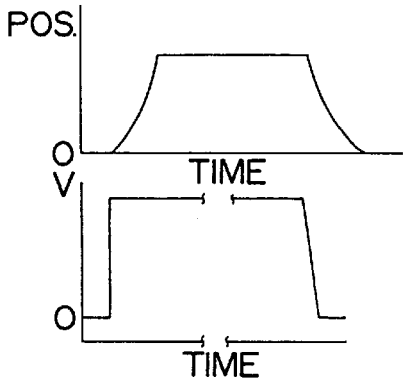
FIG. 4 is a plot of voltage applied to the injector coil during a pulse width signal for opening the fuel injector as well as a plot of injector position during the pulse width opening of the injector.

The solenoid coil 70 is energized by an application of voltage through a terminal 71 which extends through the elastomeric portion. A conductor 80 connects the terminal 71 within an outlet of engine control unit 82. During a normal engine operating mode, the engine control unit 82 applies voltage briefly to the solenoid coil 70 for a short period as illustrated in FIG. 4. This coil energizing takes place when the intake valve 28 opens every other revolution as is conventional in a four-cycle engine. During this normal engine operating mode, the engine control unit 82 energizes the fuel pump 38 through a conductor 84. Resultantly, fuel is sprayed from the injector into inlet passage 32.

When it is desired to start the engine, the ignition switch 94 is closed and engine control unit 82 is activated through wire 96. The engine control unit 82 energizes the fuel pump 38 and the ignition circuit and other components (not shown). Modern electronic fuel injectors are controlled by a microcontroller, and the injector circuit can be represented as an L/R circuit. L/R circuits have a time constant associated with them, $\tau$, which is the time in seconds required for the current to build up to 63.2 percent of the maximum value, and is equal to L/R. The microcontroller used is a low side driver; that is, the ground is switched. To measure the resistance of an injector, one must examine the discharging of the inductor. This event corresponds to turning off the injector. Once the ground is removed, the energy in the coil 70 must be dissipated. This dissipation results in a very high voltage surge or spike that propagates through the coil 70. This voltage spike is known as a fly back pulse, or fly back voltage. In order to protect the controller 82 and subsequent surrounding circuitry, a device is used to "clip" the fly back pulse. This device 100 is placed in line. In this case, a zener diode is used. The voltage is "clipped" to limit its magnitude to a predetermined maximum. The duration of time that the fly back voltage is clipped, $t_{clip}$ is related to the battery voltage, $V_B$, the clip voltage $V_z$, and the time constant, $\tau$ (which is equal to L/R), by the following relation, $$t_{clip} = \frac{L}{R}\ln\left(\frac{V_z}{V_z - V_B}\right)$$

To measure the resistance, a timer and a comparator circuit are added to the control module for determining $t_{clip}$. Given that $t_{clip}$ is known, both the battery voltage $V_B$ and the clip voltage $V_z$ are known, and that $\tau$=L/R; the resistance, R, can be found for any given temperature. Solving for R results in equation $$R = \frac{L}{t_{clip}}\ln\left(\frac{V_z}{V_z - V_B}\right)$$

This analysis requires that the battery voltage ($V_B$) is measured as is already currently done with existing engine control systems, a model clip voltage ($V_z$), and a nominal value for the inductance (L) be used. The error associated with each nominal value must be assessed, and a confidence level assigned to a calculated resistance.

Figure 5:
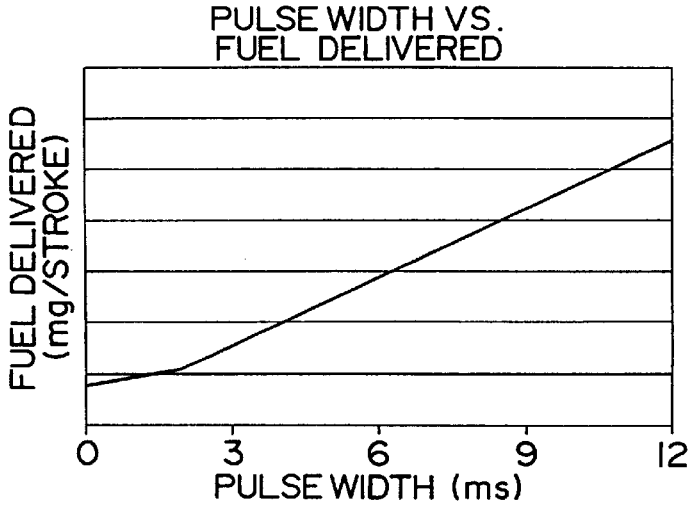
FIG. 5 is a sample plot of fuel delivered versus pulse width.

To account for the change in fuel delivered with changing injector temperature and battery voltage, it is proposed that the fuel algorithm first determine the desired fuel delivered to the cylinder for a nominal, or standard temperature and voltage using existing techniques. From this desired fuel delivered at standard temperature and voltage, the pulse width (pw) will be determined from a 2-D lookup table (fuel mass to pulse width conversion). This data is based on flow data for a given injector provided by the supplier. It will vary from application to application. The relationship between injector pulse width (pw) and actual fuel delivered is characterized in FIG. 5 which illustrates the pulse width (pw) versus the amount of fuel delivered. Once the pulse width (pw) is determined for a standard temperature and voltage, an addition or subtraction of duration to the pulse width is made based on the measured battery voltage, and calculated coil resistance at the current temperature determined from the fly back pulse. This is to compensate for the injector opening effects, which affect the amount of fuel delivered. This compensation can be obtained, for example, from a 3-D lookup table where, for a given temperature and voltage, the proper offset or compensation is given.

Therefore, the actual pulse width $pw_{actual}$ is related to the desired pulse width and the temperature and battery compensation by the following relationship:

$$pw_{actual}=pw_{std\text{-}batt,\ temp}+offset_{batt,\ temp.}$$

$$=pw_{std\text{-}batt\ volt,\ std\ coil\ temp}+offset_{actual\ batt\ volt,\ actual\ coil\ temp.}$$

Since the temperature of the injector will not change significantly with each pulse, a moving average (of resistance or temperature) can be calculated and that value can be used to determine the pulse width offset used in the relationship above.

The initial vehicle start up conditions present a unique situation. The injector temperature data is not known, because the injector hasn't fired to generate a fly back pulse. Therefore, a temperature calculation is not possible. Accordingly, an average of the battery temperature and coolant temperature can be utilized to approximate the injector temperature and then, once the injectors have fired, the fly back data can be utilized as discussed above.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A method for injecting fuel into an internal combustion engine, comprising the steps of:

providing said engine with a plurality of fuel injectors, each of said injectors including an electromechanical injection assembly for receiving fuel under pressure via a fuel supply system and for injecting a measured amount of fuel into said engine in response to a command signal whose duration is indicative of the amount of fuel to be injected;

determining a command signal for said fuel injectors based upon a measured engine speed and engine load;

measuring a resistance of a solenoid coil of said electromechanical injection assembly in accordance with a fly back pulse duration; and adjusting said command signal by incrementing or decrementing said command signal to compensate for variations in the measured resistance of said solenoid coil of said electromechanical injection assembly due to temperature variations.

2. The method according to claim 1, wherein said step of measuring a resistance of a solenoid coil further comprising the steps of:

providing a circuit including said solenoid coil;

providing a switch being opened in order to cause a collapse of the electric field in said solenoid coil for generating said fly back pulse;

measuring the duration of said fly back pulse; and determining said resistance of said solenoid coil in accordance with said duration of said fly back pulse.

* * * * *